United States Patent [19]

Cloud

[11] Patent Number: 5,029,868

[45] Date of Patent: Jul. 9, 1991

[54] GOLF PRACTICE DEVICE

[76] Inventor: Marion M. Cloud, 7521 Centreville Rd., Manassas, Va. 22111

[21] Appl. No.: 614,144

[22] Filed: Nov. 15, 1990

[51] Int. Cl.[5] ..... A63B 69/36

[52] U.S. Cl. ..... 273/186 C; 273/186 A; 273/177 R; 273/183 E

[58] Field of Search ..... 273/186 R, 186 A, 186 C, 273/186 D, 194 R, 194 A, 167 J, 163 R, 163 A, 164, 183 D, 183 E

[56] References Cited

U.S. PATENT DOCUMENTS

| | | | |
|---|---|---|---|
| 3,802,709 | 4/1974 | Elkins | 273/186 A |
| 3,953,034 | 4/1976 | Nelson | 273/186 C |
| 4,341,384 | 7/1982 | Thackrey | 273/186 A |

*Primary Examiner*—George J. Marlo
*Attorney, Agent, or Firm*—Harold H. Dutton, Jr.

[57] ABSTRACT

A practice device for use by golfers to improve their putting ability comprising a putter club having a grip portion, a shaft portion and a head portion with a putting face, and a target adapted to be positioned at a distance from the user, the club comprising a source of high intensity light housed in the grip portion, optical fibers for conducting light from the source to the putting face, and a lens enabling light from the source to be projected from the face of the club as a narrow beam of high intensity light in a direction perpendicular to the face, with the target comprising reflective device for indicating the point at which a projected light beam contacts the target, and including a plurality of parallel, vertically arranged side-by-side reflective strips, so that light projected from the club contacts the target in such a manner as to be visible to the user to indicate his point of aim.

11 Claims, 1 Drawing Sheet

GOLF PRACTICE DEVICE

This invention relates to a practice device for use by golfers. More particularly, the invention relates to a practice device for helping a golfer to improve his putting skill and accuracy.

BACKGROUND AND OBJECTS OF THE INVENTION

A large variety of devices have been produced in the past for helping a golfer to improve his golfing game. Such devices have included a variety of practice aids for a golfer to use outdoors, either on a golf course or on a practice range, and indoors, again in a specially designed practice area or simply in any convenient room. The prior devices have generally focused either on the putting portion of the golfer's game, i.e. that portion which uses a putter club and only a partial swing or a "putt", or alternatively on the full swing portion, in which the golfer uses one of the other clubs, either wood or iron, and takes a full swing to hit the ball.

The present invention is directed at improving the putting portion of the golfer's game, by helping the golfer to develop an improved putting swing or stroke, and in particular by helping the golfer to aim.

Prior art devices known for improving the putting game have included a large variety of aids such as practice holes or cups, pieces of carpet for simulating greens, sights mounted on the clubs, target devices for the holes, and so forth.

Some optical devices have also been produced in the past to provide a visual indication of whether the full swing is properly carried out, or is more likely to produce a slice or a hook. Such optical devices typically have used a series of mirrors or lenses to produce the desired result. However, as the number of mirrors and/or lenses increases, so does the complexity of the device along with the cost.

More recently, practice devices have become more technologically advanced, and one such device currently on the market uses a laser light source in the grip portion of a club, for projecting a light beam out of the end of the club. In this manner, on the back swing of the club and during the initial portion of the downswing, the golfer can observe the path of the light on the floor as an indication of whether that portion of the swing has been properly carried out.

One drawback with such a device, however, is that it only is functional on the uppermost portion of the backswing and the beginning portion of the downswing, since at other times the light beam is directed upwardly, toward the ceiling or elsewhere. Further, the light source is essentially limited to indoor use, since interference from sunlight makes it difficult to see the light path in a brightly lit area.

Practice putting devices have tended to concentrate on rather complex and cumbersome optical systems to carry out their aiming function, although they do work to some extent to help the golfer. Clearly, however, anything which attaches to the club can affect the balance and feel of the club, and thus the practice sessions do not exactly simulate the real situation. Of course the size and location of devices attached to the club can alter the swing, and thus the ball contact, when the devices are removed or a similar club without the devices is used.

The present invention seeks to overcome the disadvantages of prior art practice devices, and is particularly intended to improve a golfer's putting game. In particular, the invention seeks to provide a practice aid which incorporates a laser light source into a putter, for use in practice situations, to enable a golfer to develop a repetitive stroke when aiming and putting, and to help the golfer to aim a putter.

To this end, a primary object of the invention is to provide a putter having a light source mounted therein for being directed at a target, as an indication of the aim of the putter.

Another object of the invention is to provide a putter which incorporates a light source which does not significantly affect the balance of the club.

Still another object of the invention is to provide a golf putter which can be used with a simple, yet unique target, to provide a visual indication of the aim of the club.

Yet a further object of the invention is to provide a new golf practice putter which can help the golfer to develop a consistent putting stroke.

Still a further object is to provide a new putting practice system using optics to provide a sight.

DESCRIPTION OF THE INVENTION

The present invention provides a putter having a high intensity light source and an associated power supply mounted in the handle or grip portion of the club and means for conveying the light generated thereby through the club shaft and club head to the face of the club. In a preferred embodiment, the light source is a laser light, and the light is carried to the club face with optical fibers.

Two optical fibers or fiber bundles conduct the light to protective lenses mounted flush in the face of the club, to project the light at right angles to the club face.

A target is positioned behind the cup or hole and the light beams projected from the club face will contact the target. The target has a reflective face, preferably formed from a plurality of narrow reflective strips having different reflective angles and/or colors, and positioned side-by-side to form the face of the target. In this manner, the light beams contacting the reflective target will be reflected back to the golfer who will be able to see just where the club is aimed, by which strips appear illuminated in relation to the cup or hole.

Since both of the beams of light are perpendicular to the club face, they will be parallel to each other, and two different, spaced reflective strips will be illuminated, thus enabling the golfer to align his putt.

In another embodiment of the invention, a single light beam is projected, for practice without the use of a ball.

DESCRIPTION OF THE DRAWINGS

The foregoing and other objects and advantages of this invention will become apparent from the description of the invention which follows, in reference to the accompanying drawings, in which.

DETAILED DESCRIPTION OF PREFERRED EMBODIMENTS

Figure 1:
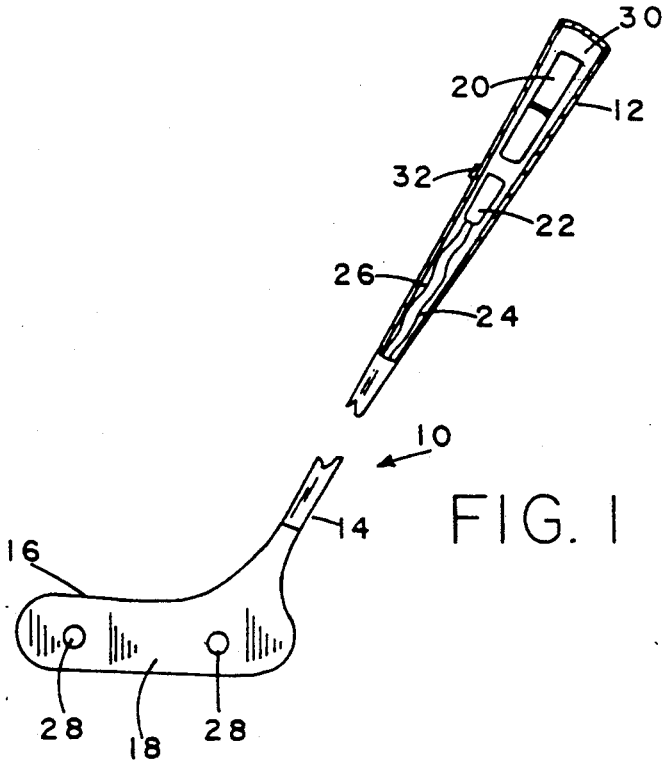
FIG. 1 is a front plan view, partially in longitudinal cross-section, of a putter incorporating the invention.

The invention will now be described with reference to the accompanying drawings. In FIG. 1 a putter generally designated 10 is seen to include at one end a handle or grip portion 12, a shaft portion 14 and at the other end a head portion 16. As is conventional, the head 16 has a ball striking surface or face 18.

The grip portion of the club according to the invention includes a power supply such as rechargeable batteries 20 for powering a light source 22, for example a laser or other high intensity light source. A pair of optical fibers 24, 26 extend from the light source 22, through the shaft 14, to the head portion 16 of the club. These fibers are of course known in the prior art, and are used for the transmission of light waves.

The optical fibers 24, 26 pass through machined out passageways in the had portion 16 of the club, and extend to the ball striking surface or club face 18. Here, the fibers 24, 26 terminate and are bonded to clear plastic lenses 28. These lenses 28 are made of a hard, preferably plastic material transparent to light, and serve to protect the ends of the fibers 24, 26 where light projects from the fibers. The fibers are positioned within the club head in such a manner that the light carried by the fibers projects from the fiber perpendicular to the face 18 of the club.

The club may also have a plug connection 30 at the handle end thereof, in order that a battery charger may be easily connected to the batteries 20 for recharging the batteries. In addition, a switch 32 is provided for turning the light on or off. Depending on the desired manner of use, the switch could be positioned in the vicinity of the user's thumb, for example. If the switch is of the momentary contact type, then the light will remain on while the switch is activated. In a variation, the switch can be in the nature of a pressure type switch incorporated into the grip of the club, so that while the club is being held for putting, pressure on the grip activates the switch to turn on the light. Other types of switch arrangements are possible.

Figure 2:
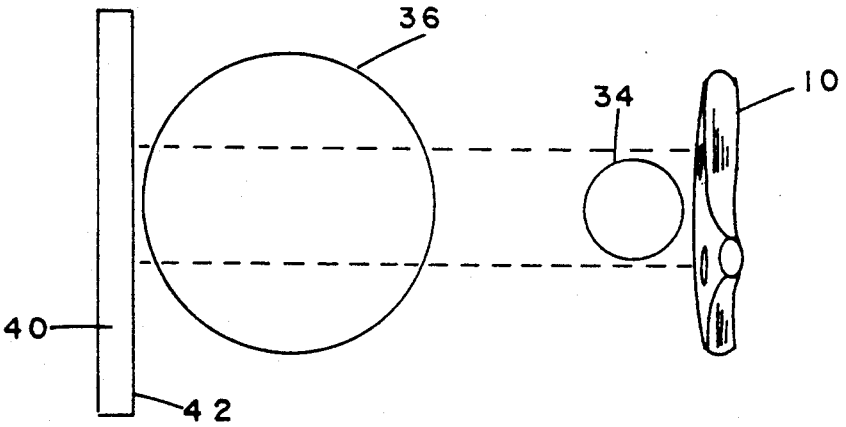
FIG. 2 is a schematic view showing the putter as seen by the golfer looking down to aim his shot.

Referring to FIG. 2, the putter 10 is shown adjacent to a ball 34, in position to aim the club for the putt toward the hole 36. The distance between the ball 34 and the hole 36 can be whatever distance the golfer may choose for a practice session.

Figure 3:
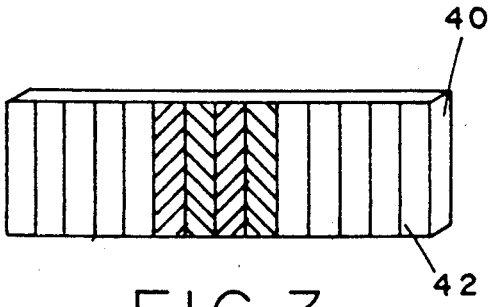
FIG. 3 is a perspective view of a target for use in the invention.

A target 40 is positioned behind the hole 36 so as to be visible to the golfer. The target 40 is provided with a reflective face 42 seen in greater detail in FIG. 3. Rather than simply one large reflector, the target 40 comprises a plurality of adjacent, vertically arranged reflective strips. In essence, the target comprises a multiplicity of side-by-side reflectors. The narrower the strips, the greater will be the accuracy of the practice putting.

With the target arranged behind the hole and preferably spaced slightly behind the hole, the golfer may begin to align his putt in a conventional manner. When the switch 32 is actuated and the light source is turned on, the light will be projected out of the lenses 28 toward the target 40. With a narrow beam of high intensity light, such a the collimated light from a laser, projected from the club face at right angles thereto, the light will contact the target 40, and in particular the reflective strips 42 and the light will be reflected back toward the user. Because of the different reflective strips, only a certain one or ones will appear to be illuminated. With the two beams of light from the club, two spaced strips will be illuminated, and the golfer can then determine whether these two illuminated strips are in line with the hole or cup. If not, the angle of the putter can be adjusted to compensate.

Figure 4:
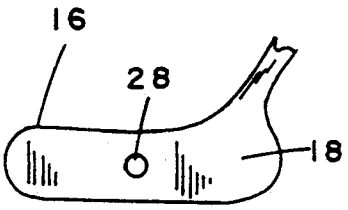
FIG. 4 is a front view of the face of a putter showing another embodiment of the invention.

In an alternative embodiment as illustrated in FIG. 4, the club face only has a single lens 28' which is positioned directly in the center of the face. Such a club can be used by the golfer without a ball, to practice and develop his putting "swing" without using a ball. The target will provide the visual indication of the direction of travel of the ball.

While the invention has been described as having certain preferred features and embodiments, it will be apparent that it is capable of still further variation and modification without departing from the spirit of the invention, and this application is intended to cover any and all variations, modifications and adaptations of the invention as fall within the spirit of the invention and the scope of the appended claims.

I claim:

1. A practice device for use by golfers to improve their putting ability comprising a putter club having a grip portion, a shaft portion and a head portion with a putting face, and a target adapted to be positioned at a distance from the user, said club comprising a source of high intensity light housed in said grip portion, means for conducting light from said source to said putting face, and means enabling light from said source to be projected from said face as a narrow beam of high intensity light in a direction perpendicular to said face, said target comprising reflective means for indicating the point at which said projected light beam contacts the target, whereby said light beam projected from said club contacts said target in such a manner as to be visible to the user.

2. A practice device for golfers as in claim 1 and wherein said light conducting means comprises two separate light paths leading from said source to said club face for enabling the light to be projected in two parallel beams.

3. A practice device for golfers as in claim 2 and wherein said light conducting means comprises optical fibers.

4. A practice device for golfers as in claim 3 and wherein said light source comprises a laser.

5. A practice device for golfers as in claim 4 and wherein said target comprises a plurality of parallel, vertically arranged side-by-side reflective strips.

6. A practice device for golfers as in claim 1 and wherein said target comprises a plurality of parallel, vertically arranged side-by-side reflective strips.

7. A practice device for golfers as in claim 6 and wherein said reflective strips are of different colors.

8. A practice device for golfers as in claim 6 and wherein said reflective strips have different angles of reflection.

9. A practice device for golfers as in claim 6 and including switch means on said grip portion for turning said light source on or off.

10. A practice device for golfers as in claim 6 and wherein said source of high intensity light includes a power supply.

11. A practice device for golfers as in claim 10 and including means for connecting said power supply to an external source of electricity for recharging said power supply.

* * * * *